US006413193B1

(12) United States Patent
Geller et al.

(10) Patent No.: US 6,413,193 B1
(45) Date of Patent: Jul. 2, 2002

(54) LIMB OR DIGIT BAND

(75) Inventors: Burton I. Geller; Andrew S. Geller, both of Lake Zurich; Greg N. Miller, Vernon Hills; Sohail Shadman, Hoffman Estates, all of IL (US)

(73) Assignee: Fingerweight Corporation, Lake Zurich, IL (US)

( * ) Notice: Subject to any disclaimer, the term of this patent is extended or adjusted under 35 U.S.C. 154(b) by 0 days.

(21) Appl. No.: 09/435,882

(22) Filed: Nov. 8, 1999

(51) Int. Cl.[7] ..... A63B 21/065

(52) U.S. Cl. ..... 482/105; 482/44; 482/48; 128/880

(58) Field of Search ..... 482/44, 47–50, 482/105; 602/22; 128/880; D10/32; D11/3; 224/164

(56) References Cited

U.S. PATENT DOCUMENTS

| | | | | | |
|---|---|---|---|---|---|
| 19,814 | A | * | 3/1858 | Monestier | 482/105 |
| 757,041 | A | | 4/1904 | Hosfeld | |
| D85,403 | S | * | 10/1931 | Swanson | D10/32 |
| 4,253,660 | A | | 3/1981 | Tiktin | |
| D362,701 | S | * | 9/1995 | Reilly | D21/196 |
| 5,547,445 | A | | 8/1996 | Chang | |
| D384,381 | S | * | 9/1997 | Reilly | D21/196 |
| 6,059,812 | A | | 5/2000 | Clerc et al. | |

* cited by examiner

*Primary Examiner*—Michael A. Brown
*Assistant Examiner*—Lori Baker Amerson

(57) ABSTRACT

The present invention includes a band for a person's limb or digit. The band has a body portion, at least one first strap portion extending in cantilever fashion from one side of the body portion toward another side of the body portion and at least one second strap portion extending in cantilever fashion from the another side of the body portion toward the one side of the body portion. The body and strap portions define an opening for receiving a limb or digit. The first and second strap portions flex when the band receives the limb or digit to securely and comfortably hold the band on the limb or digit. The band also includes at least one weight releasably securable to the body portion for increasing or decreasing the weight of the band.

19 Claims, 1 Drawing Sheet

FIG. 1
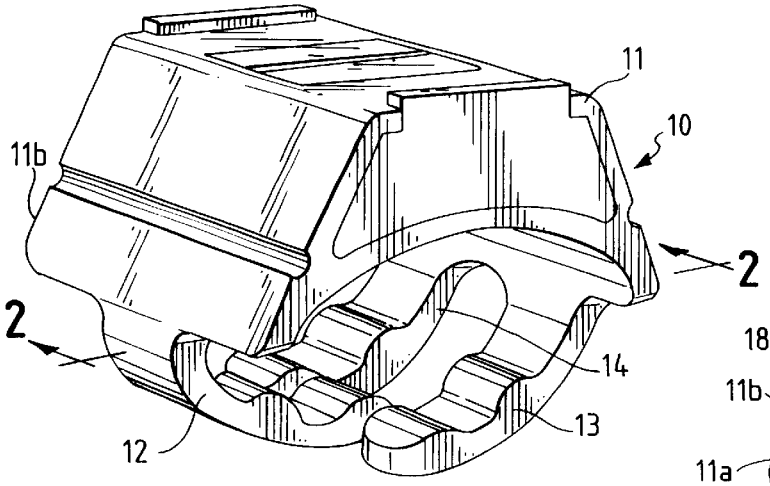
FIG. 2
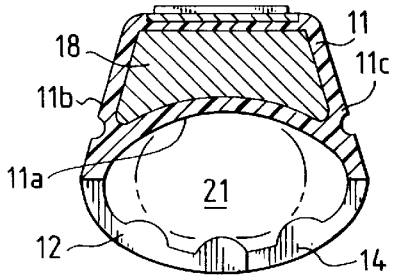
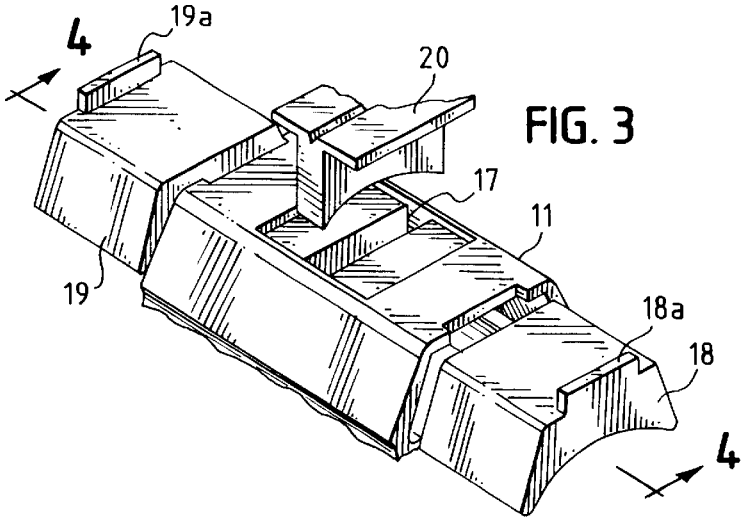
FIG. 3
FIG. 6
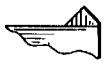
FIG. 7
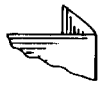
FIG. 8
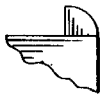
FIG. 4
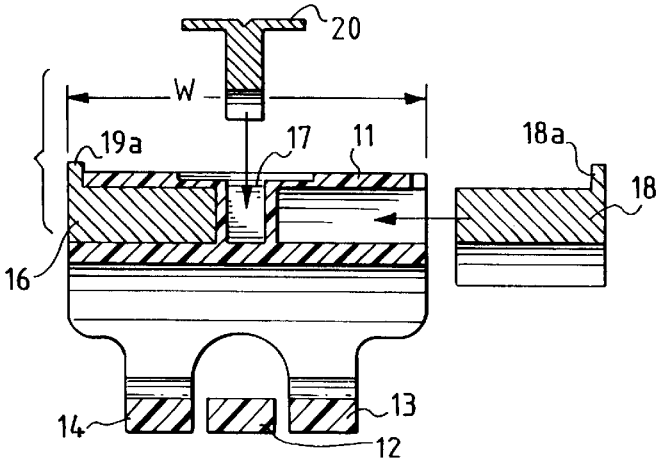
FIG. 5
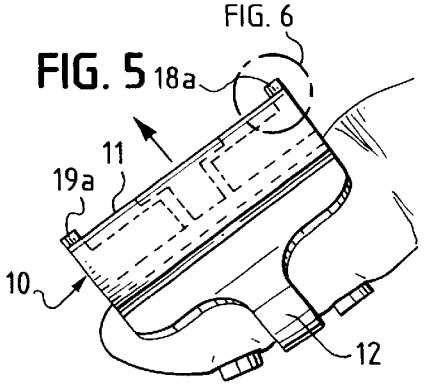

LIMB OR DIGIT BAND

BACKGROUND OF THE INVENTION

1. Field of the Invention

The present invention relates to a band for a person's body, and more particularly to a band that allows one to releasably secure weights or other objects to a person's limb or digit. Although the present invention finds particular utility in applications involving finger weights, it may also find utility in such applications as decorative bands, wrist watches, and the like.

2. Description of the Prior Art

The prior art includes a variety of hand and finger weights that one may use to exercise and strengthen his or her hands and/or fingers. One example of such prior device is the hand exerciser shown in U.S. Pat. No. 19,814 to Monestier. This device includes a lead filled shell and an elastic strap. Another example is U.S. Pat. No. 757,041 to Hosfeld which discloses a finger band with a weight whose size and shape may vary. Design Pat. Nos. Des. 384,381 and Des. 362,701 to Reilly describe two other finger weights—one with a body and a plurality of elastic bands and one with an elastic sleeve.

The prior devices suffer a number of disadvantages. They do not allow effective and comfortable attachment to a user's body; and they do not allow quick and easy adjustment of their weight.

The band of the present invention avoids the disadvantages of the prior devices. It has a simple construction that minimizes the expense of manufacture and assembly. This construction includes strap portions that flex to provide effective and comfortable attachment to one's limb or digit. The construction of the present invention allows quick and easy adjustment of its weight. It allows a user to strengthen his or her muscles and tendons in body parts such as fingers, hands, wrists and forearms while the user performs various tasks, e.g., typing, playing a musical instrument, etc. Also, a user may wear one or more of the bands of the present invention.

SUMMARY OF THE INVENTION

In accordance with one embodiment of the present invention, a band has a body portion, at least one first strap portion extending in cantilever fashion from one side of the body portion toward another side of the body portion and at least one second strap portion extending in cantilever fashion from the another side of the body portion toward the one side of the body portion. The body and strap portions define an opening for receiving a limb or digit. The first and second strap portions flex when the band receives the limb or digit to securely and comfortably hold the band on the limb or digit. The band also includes at least one weight releasably securable to the body portion for increasing or decreasing the weight of the band.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 1 is a perspective view of the band of the present invention;

FIG. 2 is a sectional view taken along line 2—2 in FIG.

FIG. 3 is a partial perspective view of the band of the present invention with the weights removed from the pockets that receive them;

FIG. 4 is a sectional view taken along line 4—4 in FIG. 3;

FIG. 5 is a side elevation view of the band secured to a finger; and

FIGS. 6–8 are fragmental side views of alternative raised portions for the raised portion circled in FIG. 5.

While the following disclosure describes the invention in connection with one embodiment, one should understand that the invention is not limited to this embodiment. Furthermore, one should understand that the drawings are not to scale and that graphic symbols, diagrammatic representatives, and fragmentary views, in part, may illustrate the embodiment. In certain instances, the disclosure may not include details which are not necessary for an understanding of the present invention.

DETAILED DESCRIPTION OF THE DRAWINGS

Turning now to the drawings and referring specifically to FIG. 1, the band of the present invention shown at 10 serves as a finger weight and generally includes a body portion 11 and integrally formed first strap portion 12 and second strap portions 13 and 14. (Although the embodiment shown serves as a finger weight for users such as musicians and typists, the band of the present invention may find utility in such applications as decorative bands, wrist watches and the like.) The body and strap portions are made of a composite material comprising carbon black dispersed in compounded mineral filled alloy of ethylene vinyl acetate and polyurethane with an internal lubricant. These portions may also be made of any other suitable material.

The body portion 11 has a predetermined width W (See FIG. 4) and a rounded bottom 11*a* for engaging the top of a person's finger. It defines side pockets 15 and 16 and a top pocket 17. (See FIG. 3 and 4) The pockets 15–17 receive weights 18–20, respectively. The width W is a magnitude sufficient to accommodate weights that allow the band to attain a predetermined total weight. Each of the side pockets 15 and 16 extends from a side opening towards the center of the body portion 11 while the top pocket extends downwardly from an open top and has a T-like configuration.

The first strap portion 12 extends in cantilever fashion from one end 11*b* of the body portion 11 toward an opposite end 11*c* of the body portion 11 to a point proximate the middle between the ends 11*b* and 11*c*. The second strap portions 13 and 14 lie in spaced, generally parallel relation and similarly extend from the opposite end 11*c* toward the one end 11b to a point proximate the middle between the ends 11*b* and 11*c*. The distal end of the first strap portion 12 lies between the distal ends of the second strap portions 13 and 14. Thus, these distal ends of the strap portions 12–14 lie in spaced, side-by-side and interlaced relation as shown in FIGS. 1 and 4.

The body portion 11 and the first and second strap portions 12–14 define an opening 21 that receives a finger in this embodiment or any other part of a person's body (e.g., arms, legs, neck, etc.) in other embodiments. The first and second strap portions 12–14 are elongate portions with a width substantially smaller than that of the body portion 11. They have undulated inner surfaces which allow the band 10 to firmly grip the finger or other body part around which the band extends. (FIG. 5 shows the band 10 around the tip of a person's finger.) The weights 18–20 are made of metal or any other suitably heavy and rigid material. They generally have the shape of the pockets that receive them; they slide in and out of those pockets in response to force provided by a user; and they maintain their positions in the pockets under the friction force generated between them and the walls of the pockets. The weights 18 and 19 include raised portions 18*a* and 19*a*, respectively. These raised portions extend into corresponding grooves in the body portion 11; and they extend outwardly of the body portion 11 to facilitate their removal from the body portion 11. (FIGS. 6–8 show alternative raised portions for the raised portions 18*a* and 19*a*.)

Although the embodiment shown in FIGS. 1–5 includes three weights, the band of the present invention may have fewer than three weights or more than three weights. Similarly, although this embodiment includes one first strap portion 12 and two second strap portions 13 and 14, the band 10 may have more than one first strap portion 12. It may also have fewer or more than two second strap portions 14 interlaced with the first strap portion or portions 12.

While the above description and the drawings disclose and illustrate one embodiment, one should understand, of course, that the invention is not limited to this embodiment. Those skilled in the art to which the invention pertains may make other modifications and other embodiments employing the principles of this invention, particularly upon considering the foregoing teachings. Therefore, by the appended claims, the applicants intend to cover any modifications and other embodiments as incorporate those features which constitute the essential features of this invention.

What is claimed is:

1. A band for limbs or digits, said band comprising a body portion, at least one first strap portion extending in cantilever fashion from one side of the body portion toward another side of the body portion, at least one second strap portion extending in cantilever fashion from the another side of the body portion toward the one side of the body portion, and at least one weight segment releasably secured to the body portion, the body and strap portions defining an opening for receiving a limb or digit of one using the band, the first and second strap portions flexing when the band receives the limb or digit.

2. The band of claim 1, wherein the body portion has a predetermined width and each of the first and second strap portions have a predetermined width that is substantially smaller than the predetermined width of the body portion.

3. The band of claim 1, wherein a transverse cross-sectional shape of the opening defined by the body and strap portions has a generally oval shape.

4. The band of claim 1, wherein the band includes a plurality of weight segments releasably secured to the body portion.

5. The band of claim 1, further comprising a plurality of second strap portions, wherein the distal ends of the first and second strap portions interlace with each other in side-by-side relation.

6. The band of claim 1 or 5, wherein each of the first and second strap portions includes an undulated inner surface.

7. A band for limbs or digits, said band comprising a body portion and at least one first strap portion extending in cantilever fashion from one side of the body portion toward another, opposite side of the body portion and a plurality of second strap portions extending in cantilever fashion from the opposite side of the body portion toward the one side of the body portion, the distal ends of the first and second strap portions interlacing with each other in side-by-side relation, the body and strap portions defining an opening for receiving a limb or digit of one using the band, the first and second strap portions flexing when the band receives the limb or digit, said band further comprising at least one weight segment releasably secured to the body portion.

8. The band of claim 7, wherein each of the first and second strap portions includes an undulated inner surface.

9. The band of claim 7, wherein the body portion has a predetermined width and each of the first and second strap portions have a predetermined width that is substantially smaller than the predetermined width of the body portion.

10. The band of claim 7, wherein a transverse cross-sectional shape of the opening defined by the body and strap portions has a generally oval shape.

11. The band of claim 7, wherein the band includes a plurality of weight segments releasably secured to the body portion.

12. A band for limbs or digits, said band comprising a body portion and at least one first strap portion extending in cantilever fashion from one side of the body portion toward another, opposite side of the body portion and a plurality of second strap portions extending in cantilever fashion from the opposite side of the body portion toward the one side of the body portion, the distal ends of the first and second strap portions interlacing with each other in side-by-side relation, the body and strap portions defining an opening for receiving a limb or digit of one using the band, the first and second strap portions flexing when the band receives the limb or digit, said band further comprising at least one weight segment releasably secured to the body portion.

13. The band of claim 12, further comprising a plurality of weight segments releasably secured to the body portion.

14. The band of claim 13, wherein each weight segment includes means for grasping the weight.

15. A band for limbs or digits, said band comprising a body portion, one first strap portion extending from one side of the body portion toward but short of another side of the body portion, two second strap portions extending from the another side of the body portion toward but short of the one side of the body portion, the body and strap portions defining an opening for receiving a limb or digit, the second strap portions disposed in spaced side-by-side relation, the first strap portion extending between the two second strap portions, the first and second strap portions include ends that lie in a spaced side-by-side arrangement.

16. The band of claim 15, wherein the body portion has a predetermined width and each of the first and second strap portions have a predetermined width that is substantially smaller than the predetermined width of the body portion.

17. The band of claim 15, wherein a transverse cross-sectional shape of the opening defined by the body and strap portions has a generally oval shape.

18. The band of claim 15, wherein each of the first and second strap portions includes an undulated inner surface.

19. The band of claim 15, wherein the body portion and the strap portions are a one-piece integrally formed unit.

* * * * *